United States Patent [19]

Choi

[11] Patent Number: 4,932,661

[45] Date of Patent: Jun. 12, 1990

[54] EXTENSIBLE EXERCISE GOLF CLUB

[76] Inventor: Richard W. Choi, 111 S. Poinsettia Pl., Los Angeles, Calif. 90036

[21] Appl. No.: 372,249

[22] Filed: Jun. 27, 1989

[51] Int. Cl.[5] ..... A63B 69/36

[52] U.S. Cl. ..... 273/186 A; 273/81.2; 273/80 D

[58] Field of Search ..... 273/186 A, 186 C, 186 R, 273/193 R, 193 A, 193 B, 194 R, 194 A, 194 B, 80 D, 81.2, 80.1

[56] References Cited

U.S. PATENT DOCUMENTS

| | | | |
|---|---|---|---|
| 2,107,983 | 12/1936 | Hamilton | 273/80 |
| 2,214,079 | 9/1938 | Horton | 273/77 |
| 2,772,887 | 12/1956 | Blake | 273/186 A |
| 3,070,370 | 12/1959 | Steiner | 273/81 |
| 3,102,726 | 6/1961 | Barrett | 273/81.2 |
| 3,214,170 | 6/1962 | Warnock | 273/80.1 |
| 3,524,646 | 6/1967 | Wheeler | 273/81.2 |
| 3,528,660 | 11/1968 | Kategian | 273/80 |
| 3,539,185 | 11/1970 | Andis | 273/81.2 |
| 3,663,019 | 5/1972 | Palotsee | 273/81.3 |
| 3,829,092 | 8/1974 | Arkin | 273/77 A |
| 3,840,231 | 10/1974 | Moore | 237/79 |
| 4,343,473 | 8/1982 | Laursen | 273/186 A |
| 4,674,747 | 6/1987 | Mazzocco et al. | 273/81.2 |

*Primary Examiner*—George J. Marlo

*Attorney, Agent, or Firm*—Birch, Stewart, Kolasch & Birch

[57] ABSTRACT

An extensible exercise golf club including a golf club shaft comprising a plurality of telescopic interlocking shaft lengths which function to extend from a collapsed position to a fully extended position as a result of the force generated by the swinging action of the golf club.

4 Claims, 3 Drawing Sheets

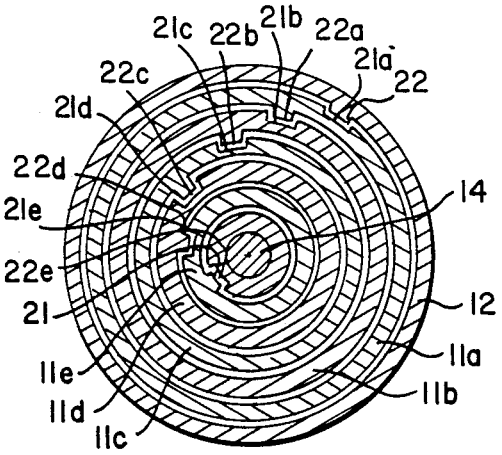
FIG. 4
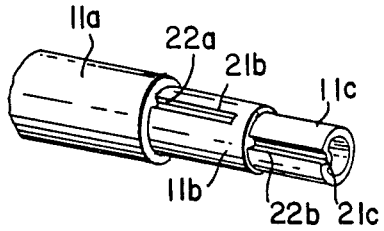
FIG. 5
FIG. 6
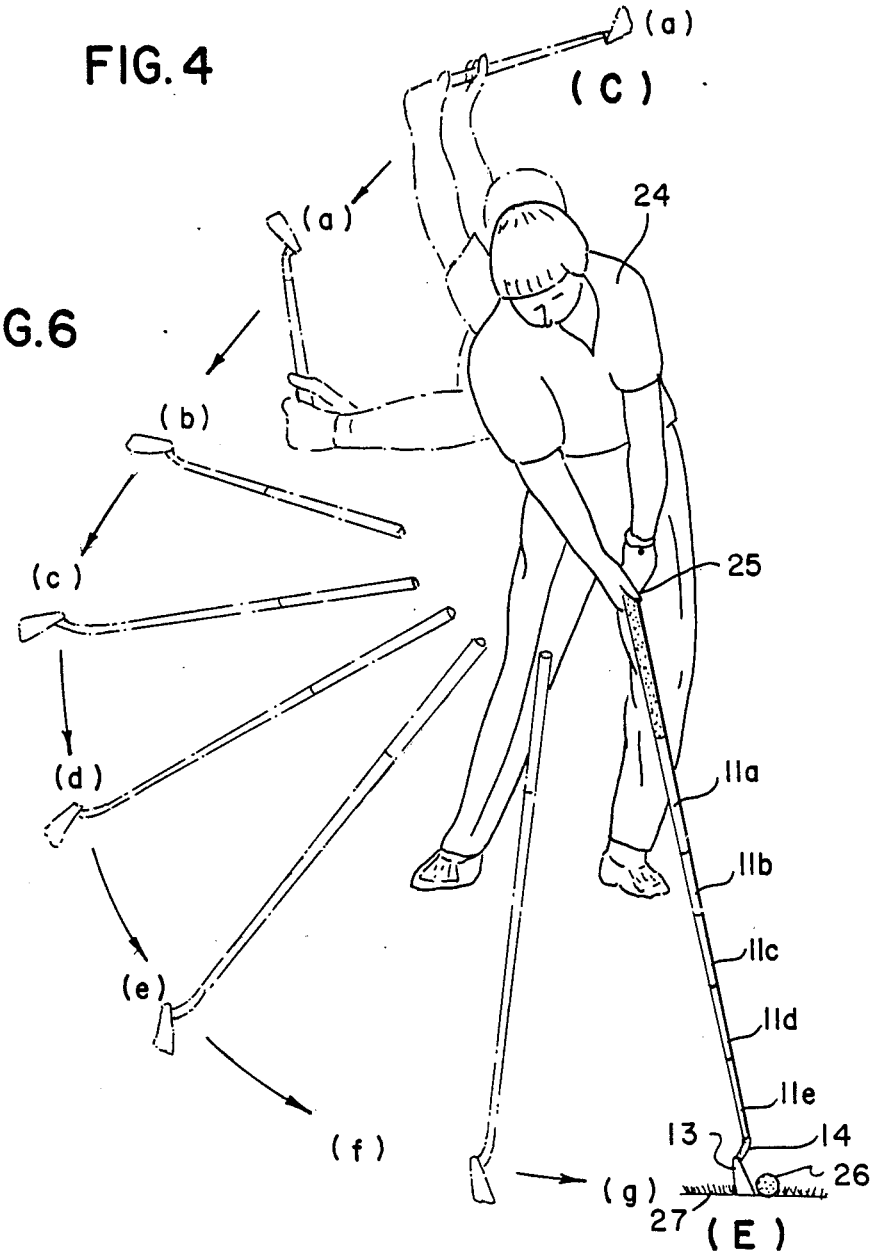

EXTENSIBLE EXERCISE GOLF CLUB

BACKGROUND OF THE INVENTION

1. Field of the Invention

The present invention relates to an extensible exercise golf club for training golfers and more particularly, to an exercise golf club which includes a plurality of telescopic interlocking tubular shaft lengths which can optionally include a spring disposed therein for causing the telescoped shaft members to extend from a collapsed position to a fully extended position. Thus golf beginners can learn to swing very well with very little effort, thus effectively reducing the training period.

2. Description of the Prior Art

Several types of collapsible golf clubs are known in the art. For example, such golf clubs include those which possess adjustable shaft lengths; means for varying the grip of golf clubs axially collapsible shafts, or the like. However, such collapsible golf clubs suffer from many problems. For example, it is difficult for a beginning golfer to timely hit a golf ball by using such golf clubs and to properly control the power transferred from the legs of the golfer to a golf club head.

SUMMARY OF THE INVENTION

Accordingly, it is an object of the present invention to provide an improved exercise golf club for use in training golfers.

Another object of the present invention is to provide an extensible exercise golf club which includes a plurality of concentric, telescopic interlocking tubular light shafts containing springs disposed therein within several tubular shaft lengths starting from the handle member. Alternatively, the springs are replaced with a plurality of friction locks between tubular shaft lengths.

A further object of the present invention is to provide an extensible golf club which includes, alternatively, a channel and a rail disposed on the inner and outer surfaces of adjacent telescopic tubular shaft lengths, respectively, for preventing the shaft lengths from twisting.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to an extensible exercise golf club including a golf club shaft which comprises a plurality of telescopic interlocking shaft lengths which function to extend from a collapsed position to a fully extended position as a result of the force generated by the swinging action of the golf club.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 4 is a cross-sectional view of FIG. 1, taken along line 4—4;

FIG. 5 is a perspective view of the extensible tubular sections according to the present invention;

FIG. 6 is a pictorial view, showing a golfer using the extensible golf club according to the present invention.

DESCRIPTION OF THE PREFERRED EMBODIMENTS

Figure 1:
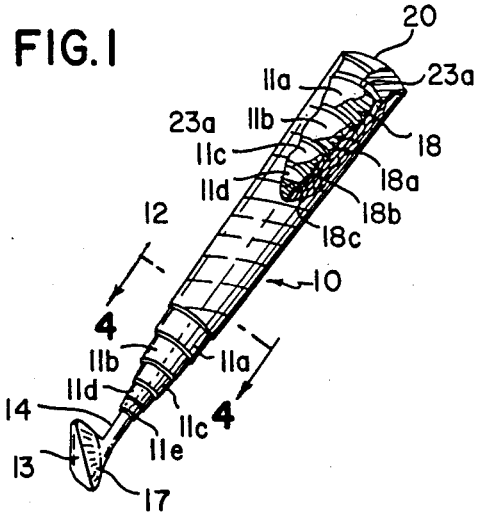
FIG. 1 is a perspective view of an extensible golf club according to the present invention in a fully collapsed position, showing in cut away portions thereof the basic components of the present invention.
Figure 3B:
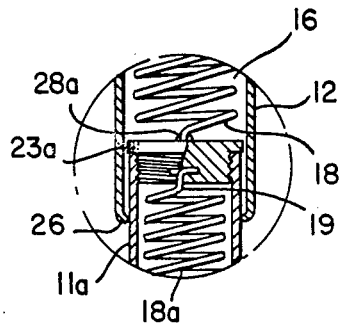
FIG. 3 is a sectional view of FIG. 2, taken along line 3—3, showing the connecting portions of a tubular shaft length.
Figure 2:
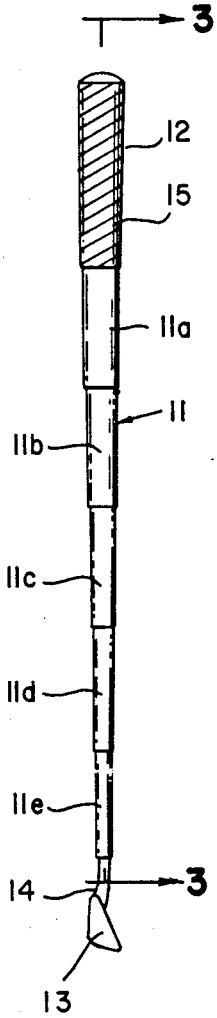
FIG. 2 is a front view of the extensible club according to the present invention in a fully extended position.
Figure 3A:
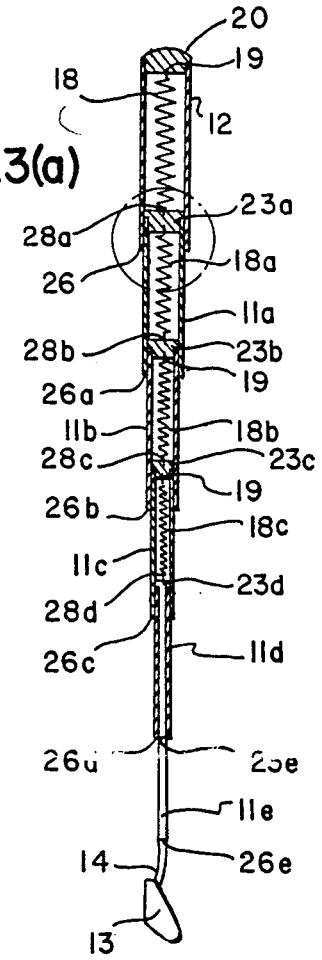

Referring now in detail to the drawings for the purpose of illustrating preferred embodiments of the present invention, the extensible exercise golf club 10 as shown in FIGS. 1, 2, and 3 comprises an extensible shaft 10 defining a plurality of concentric, telescopic interlocking tubular shaft lengths 11*a*, 11*b*, 11*c*, 11*d*, and 11*e*, a club head 13 at one end, a tubular handle member 12 at the other end of the extensible shaft 10, and a cap 20 for covering the top of the tubular handle member 12.

The handle member 12 is provided with a typical golf club grip member 15 disposed therearound for permitting a tight grasp of the club. The club head includes a ball engaging surface 17. The cap 20 is provided with a spring 18 suspended from the inner surface thereof. The telescopic interlocking tubular length shafts 11*a*, 11*b*, 11*c*, 11*d*, and 11*e* include extended lids 23*a*, 23*b*, 23*c*, 23*d*, and 23*e* disposed at the top and end openings 26*a*, 26*b*, 26*c*, and 26*d* disposed at the bottom thereof, respectively. The shaft length 11*e* is provided with an end portion 26*e* for receiving a heel shaft 14 which extends into the club head 13. The tubular handle 12 is provided with an end opening 26. The extended lid 23*a* is extends a short distance into the end opening 26 of the tubular handle member 12. Similarly, the extended lids 23*b*, 23*c*, 23*d*, and 23*e* extend a fraction of their shaft length into the end openings 26*a*, 26*b*, 26*c*, and 26*d*, respectively. The extended lids 23*a*, 23*b*, and 23*c* contain springs 18*a*, 18*b*, and 18*c* disposed on the inner surfaces thereof, respectively, and also the extended lids 23*a*, 23*b*, 23*c*, and 23*d* contain hooks 28*a*, 28*b*, 28*c*, and 28*d* disposed on the outer surface thereof for tightly engaging the springs 18, 18*a*, 18*b*, and 18*c* in its assembly (FIG. 3).

As shown in FIGS. 4 and 5, the telescopic interlocking tubular length shafts 11*a*, 11*b*, 11*c*, 11*d*, and 11*e* contain channels 21*a*, 21*b*, 21*c*, 21*d*, and 21*e* disposed on the outer surfaces and alternatively contain rails 22*a*, 22*b*, 22*c*, 22*d*, and 22*e* disposed on the inner surfaces thereof. Also, the heel shaft 14 contains a channel 21 disposed on the outer surface thereof and the tubular handle 12 contains a rail 22 disposed on the inner surface thereof. Therefore, the rails 22, 22*a*, 22*b*, 22*c*, 22*d*, and 22*e* are operatively interengaged with the channels 21*a*, 21*b*, 21*c*, 21*d*, 21*e*, and 21*f* for operatively extending the length shafts 11*a*, 11*b*, 11*c*, 11*d*, and 11*e* and effectively preventing the shaft length 10 from twisting while the golfer swings.

In assembly, first of all, the shaft length 11*e* receives the heel shaft 14 of the club head 13. Shaft length 11*d* is easily inserted into the end opening 26*d* of shaft length 11*d* to the extended lid 23*e* of the shaft length 11*e*. The shaft length 11*d* is similarly engaged with the shaft length 11*c*. At that time, the spring 18 suspended from the expanded lid 23*c* is tightly engaged with the hook 28*d* of the shaft length 11*d*. Thereafter, the extended lid 23*c* is slidably inserted into the end opening 26*b* of the shaft length 11*b*. Thus, the shaft length 11*b* is engaged in the shaft length 11*a* and the shaft length 11*a* is engaged in the tubular handle 12 (FIGS. 2 and 3).

In operation, as shown in FIG. 6, when a golfer swings forward, the golf club 10 is gradually extended in the direction indicated by arrows (a), (b), (c), (d), (e), (f), and (g) from the collapsed position (C) to the extended position (E). At that time, the club head 13 rhythmically hits a golf ball 26 disposed on the ground 27 and the golfer can play with a little effort being required by the golfer.

Figure 7:
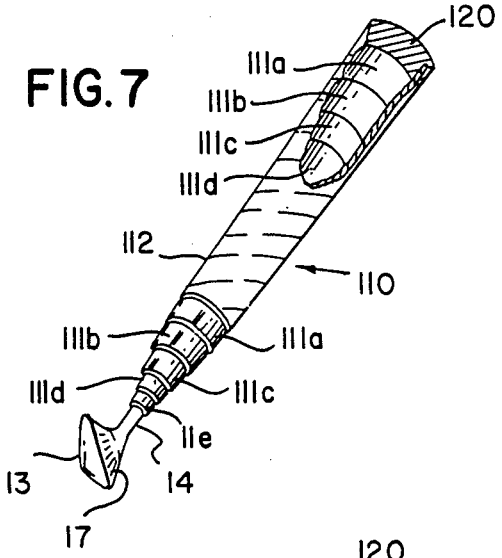
FIG. 7 is perspective view of an additional embodiment of an extensible golf club according to the present invention in a fully collapsed position showing, in cut away portions thereof, the basic components of the present invention.
Figure 8:
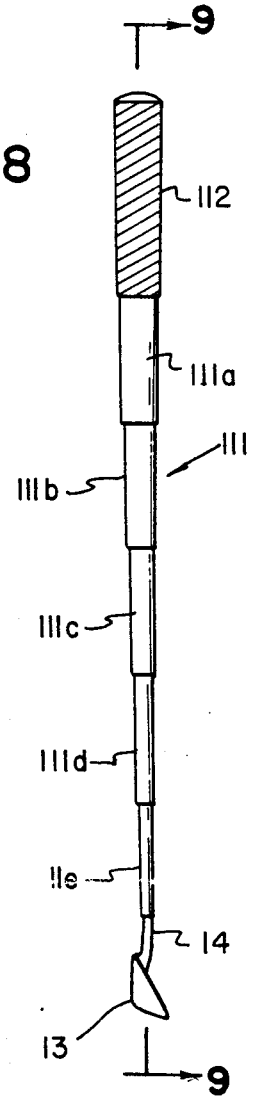
FIG. 8 is a front view of the additional embodiment of the extensible golf club of FIG. 7 in a fully extended position of the present invention.
Figure 9:
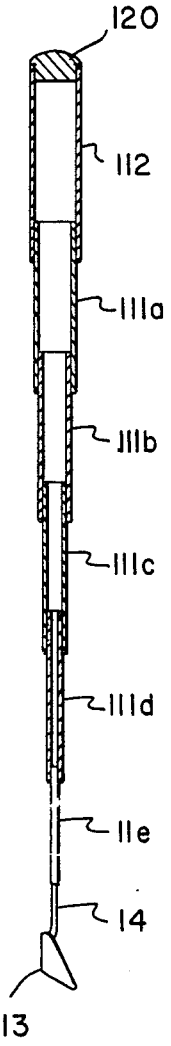
FIG. 9 is a sectional view of FIG. 8, taken along line 8—8 showing the connecting portions of the tubular shaft lengths.

Referring in detail to FIGS. 7, 8 and 9, there is illustrated an additional embodiment of an extensible exercise golf club 110 in accordance with the present invention.

FIG. 7 is perspective view of an additional embodiment of an extensible golf club according to the present invention in a fully collapsed position showing in cut away portions thereof the basic components of the present invention. FIG. 8 is a front view of the additional embodiment of the extensible golf club of FIG. 7 in a fully extended position. FIG. 9 is a sectional view of FIG. 8, taken along line 9—9 showing the connection portions the of tubular shaft lengths.

The extensible exercise golf club 110 comprises an extensible shaft 111 which defines a plurality of telescopic interlocking shaft lengths 111*a*, 111*b*, 111*c*, 111*d*, and 11*e*, a club head 13 at one end thereof, a tubular handle member 120 at the other end of the extensible shaft 111, and a cap 120 for covering the top of the tubular handle member 120.

Thus, the extensible exercise golf club 110, according to the present invention, is distinguishable from the extensible exercise golf club 10 in that the extensible golf club 110 does not contain springs disposed within the tubular handle member 112 and shaft lengths 111*a*, 111*b*, and 111*d*, respectively.

In the operation, the extensible members of the exercise golf club 110 are slidably and frictionally engaged with each other so that the force of the swing overcomes the frictional engagement for freely extending the club shaft during the swing operation of the golf club for striking the ball 26 positioned in the ground 27.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. An extensible exercise golf club which comprises:

a club head member, a club handle member, and a club shaft member disposed therebetween, said club shaft member including:

a plurality of telescopic tubular members which telescopically fit into each other for slidably extending from a telescopically collapsed position to a telescopically extended position, and channel and rail members disposed alternately on the inner and outer surfaces of adjacent telescopic tubular members, said rail member of one tubular member engaging said channel member of an adjacent tubular member for interlocking said adjacent telescopic tubular members together, whereby upon the swinging of the golf club, the club shaft member of the golf club is telescopically extended and guided by the engagement of the rail member within the channel member whereby the twisting of adjacent shaft members is effectively prevented.

2. The extensible exercise golf club of claim 1, wherein the plurality of the telescopic tubular members contain spring members which connect adjacent telescopic tubular members together, said spring members being biased to provide resistance against the slidable extension of the telescopic tubular members as they extend from a collapsed position to a fully extended position during the swinging of the golf club.

3. The extensible exercise golf club of claim 2, wherein the adjacent telescopic tubular member are in slidable and frictional engagement with each other so that the force of the swing overcomes the frictional engagement for fully extending the club shaft during the swing operation of the golf club.

4. The extensible exercise golf club of claim 1, wherein said plurality of telescopic tubular members is at least three in number.

* * * * *